US005399840A

United States Patent [19]

Goeddeke

[11] Patent Number: 5,399,840

[45] Date of Patent: Mar. 21, 1995

[54] BLOCK HEATING SYSTEM WITH THERMISTOR PROBE

[75] Inventor: John W. Goeddeke, Franklin Park, Ill.

[73] Assignee: Lab-Line Instruments, Inc., Melrose Park, Ill.

[21] Appl. No.: 207,605

[22] Filed: Mar. 9, 1994

[51] Int. Cl.[6] ..... H05B 3/70

[52] U.S. Cl. ..... 219/521; 219/450; 219/386

[58] Field of Search ..... 219/521, 449, 450, 385–387

[56] References Cited

U.S. PATENT DOCUMENTS

| | | | |
|---|---|---|---|
| 1,917,305 | 7/1933 | Johnson | 219/521 |
| 2,487,161 | 11/1949 | Melton | 219/521 |
| 2,932,718 | 4/1960 | Marsters | 219/521 |
| 3,141,948 | 7/1964 | Young | 219/521 |
| 3,607,134 | 9/1971 | McIntyre | 219/521 |
| 3,786,220 | 1/1974 | Harnden | 219/450 |
| 3,790,346 | 2/1974 | Ritchie . | |
| 3,831,002 | 8/1974 | Mysicka et al. | 219/432 |
| 3,986,082 | 10/1976 | Land | 219/210 |
| 4,399,351 | 8/1983 | Koff | 219/450 |
| 4,504,733 | 3/1985 | Walsh | 219/521 |
| 4,713,523 | 12/1987 | MacDonald | 219/521 |
| 4,950,608 | 8/1990 | Kishimoto | 219/439 |
| 4,967,061 | 10/1990 | Weber | 219/521 |
| 5,044,428 | 9/1991 | Nohl . | |
| 5,073,697 | 12/1991 | Uchiyama | 219/521 |
| 5,148,004 | 9/1992 | Gettig et al. | 219/390 |

OTHER PUBLICATIONS

Lab-Line Instruments, Inc. catalog pp. H-2 and H-3 (1993).

*Primary Examiner*—Teresa J. Walberg
*Attorney, Agent, or Firm*—Emrich & Dithmar

[57] ABSTRACT

A block heating system includes a housing defining an open-top well closed at the bottom by a base plate which is heated by an electric heater in the housing. One or more carrier blocks are removably received in the well, each block having a plurality of receptacles in the top face for receiving test tubes or the like to be heated. A temperature probe assembly includes a rigid metal sheath projecting up into the well from the base plate and receivable in a bore in the bottom of one of the carrier blocks. A thermistor at the tip of the sheath senses the temperature in the middle of the block, which is displayed on an LED display on the front panel of the housing.

16 Claims, 1 Drawing Sheet

BLOCK HEATING SYSTEM WITH THERMISTOR PROBE

BACKGROUND OF THE INVENTION

1. Field of the Invention

This invention relates to the electrical heating of articles, such as test tubes, by means of a heated block having receptacles containing the tubes.

2. Description of the Prior Art

Applicants' assignee, Lab-Line Instruments, Inc., has, commercially manufactured a series of heaters designed for laboratory-type use, which heaters differ from the heating system described and claimed herein fundamentally in the manner in which the temperature of the heated articles is sensed.

Such prior art heaters include a housing which defines in the top thereof an open-top well, closed at the bottom by a base plate which is heated by an electric heater disposed in the housing. One or more carrier blocks formed of a material having a high thermal conductivity, such as aluminum, are removably receivable in the well, each block having a plurality of receptacles formed in its upper face for receiving associated articles to be heated, such as test tubes or the like. The base plate is heated by the heater and the heat is transferred into the block and thereby into the test tubes or other articles received in the block receptacles, the temperature being controlled by suitable controls on the front panel of the housing.

In this prior arrangement, the temperature of the contents of the test tubes is monitored manually by insertion of a thermometer. This technique is somewhat inefficient, requiring manual intervention and requiring the use of a separate thermometer probe which must be maintained and manipulated.

SUMMARY OF THE INVENTION

It is a general object of the invention to provide an improved heating system which avoids the disadvantages of prior heating systems while affording additional structural and operating advantages.

An important feature of the invention is the provision of a heating system of the type set forth, which does not require manual intervention to sense the temperature of heated articles.

In connection with the foregoing feature, a further feature of the invention is the provision of a heating system of the type set forth, which automatically senses and displays the temperature.

Still another feature of the invention is the provision of a heating system of the type set forth, which is of relatively simple and economical construction.

A still further feature of the invention is the provision of a housing and temperature probe assembly for the heating system of the type set forth.

Yet another feature of the invention is the provision of a removable carrier block for a heating system of the type set forth.

These and other features of the invention are attained by providing a heating system comprising: a base plate, a heater for heating the base plate, a rigid thermoelectric temperature probe assembly upstanding from the base plate and terminating in a tip for sensing the temperature at the tip and producing an electrical output signal representing the temperature sensed, an indicator coupled to the probe assembly and responsive to the output signal for producing an indication of the temperature sensed, and a block of material having a high thermal conductivity and removably receivable on the base plate in a heating position, the block having a top face and a bottom face and a plurality of receptacles formed in the top face for receiving associated articles to be heated, the block having a bore formed in the bottom face and dimensioned for freely receiving therein the probe assembly when the block is disposed in its the heating position for measuring the temperature within the block and thereby the temperature of articles being heated.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 3:
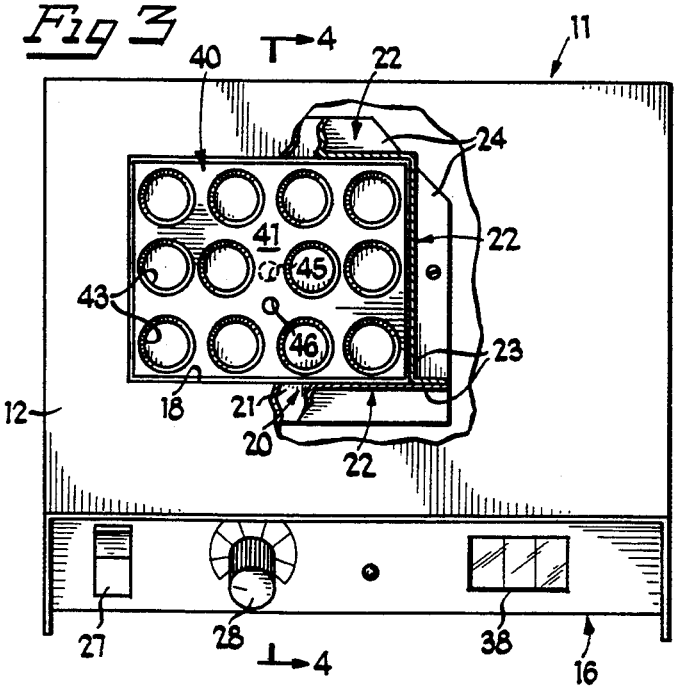
FIG. 3 is an enlarged, top plan view of the heating system of FIG. 1, with portions broken away more clearly to show the internal construction.
Figure 5:
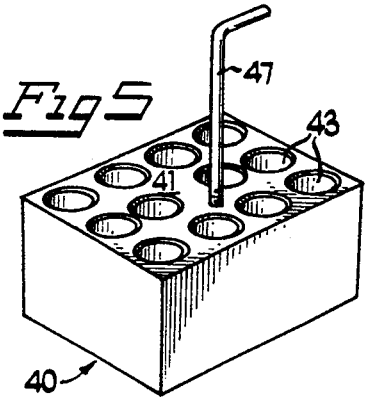
FIG. 5 is a perspective view of the block of the heating system of FIG. 3, with the handle attached.
Figure 6:
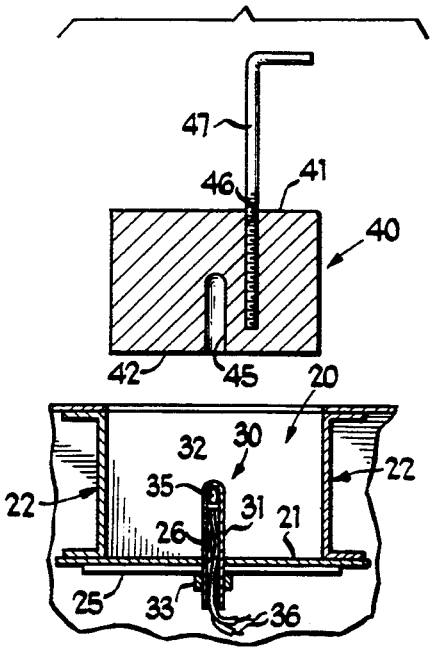
FIG. 6 is a fragmentary sectional view of the heating system of FIG. 4, illustrating the block about to be inserted in the well.
Figure 4:
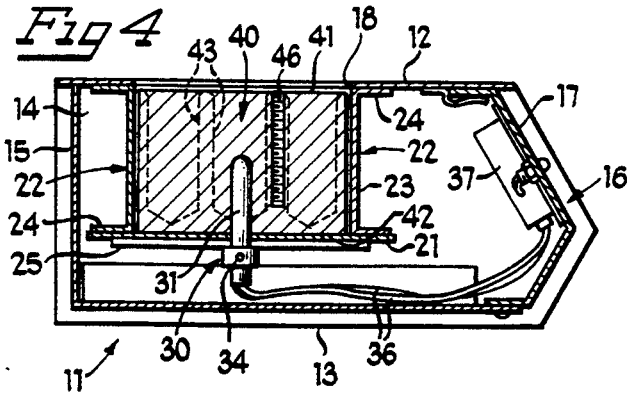
FIG. 4 is a view in vertical section taken along the line 4—4 in FIG. 3.

Referring to FIGS. 1, 3, 4 and 6, there is illustrated a heating system, generally designated by the numeral 10, constructed in accordance with and embodying the features of the present invention. The heating system 10 includes a box-like housing 11 having a top wall 12, a bottom wall 13, opposed side walls 14 and an upstanding rear wall 15 (FIG. 4). The front of the housing 11 is closed by a front wall 16 which includes an upper portion in the form of a downwardly and forwardly sloping panel 17. Formed in the top wall 12 is a large rectangular opening 18 which defines the entrance into a well 20. Referring in particular to FIGS. 3, 4 and 6, the well 20 is closed at the bottom thereof by a rectangular base plate 21 and has four upstanding side walls 22, each preferably in the form of a channel member having an upstanding wall portion 23 integral at the upper and lower ends thereof with laterally outwardly extending flanges 24 which are, respectively, fixed to the inner surface of the top wall 12 and the upper surface of the base plate 21.

Fixed to the underside of the base plate 21 and covering substantially the entire bottom area of the well 20 is an electric heater 25. It will be appreciated that the heating system 10 is provided with an AC power cord (not shown) for plugging into an associated AC power source, such as a 120 V, 60 Hz outlet, the heater 25 being coupled to the AC supply through a suitable power supply circuitry (not shown). An ON-OFF power switch 27 may be provided on the front wall panel 17 to turn on and off the AC power to the heater 25, and the temperature may be regulated by means of a heater control knob 28 on the panel 17 coupled to a suitable rheostat or the like in a heater control circuit (not shown), all in a known manner.

It is a fundamental aspect of the invention that the heating system 11 is provided with a temperature probe assembly 30, which includes an elongated, rigid, hollow, tubular, metal sleeve 31 closed at one end to form a tip 32. The sleeve 31 is received through complementary openings centrally in the base plate 21 and the electric heater 25 so as to be upstanding in the well 20 with the tip 32 disposed substantially at the center of the well 20. More specifically, the sleeve 31 may be fixed in place by a suitable bushing 33 and pin 34. A thermistor 35 is disposed inside the tip 32 of the sleeve 31 and is coupled by electrical conductors 36 to a circuit board 37, mounted on the inside of the front wall panel 17 and carrying an LED display 38 which is visible through a complementary opening in the panel 17.

It will be appreciated that the thermistor 35 senses the temperature at the tip 32 of the probe assembly 30 and generates an electrical output signal which, in turn, operates known circuitry on the circuit board 37 to actuate the LED display 38 to provide a digital indication of the temperature sensed in suitable units of measurement, such as tenths of a degree centigrade. It is significant that the sleeve 31 is rigid and free standing within the well 20, and it is formed of a material having good thermal conductivity.

Figure 1:
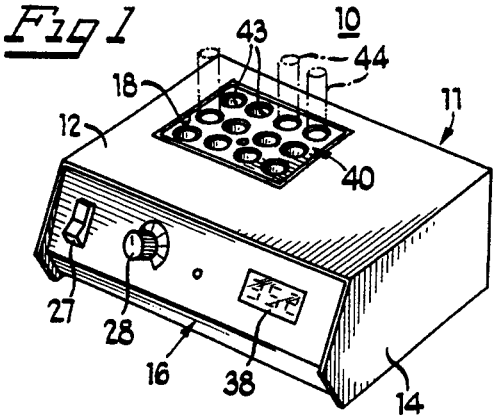
FIG. 1 is a perspective view of a heating system constructed in accordance with and embodying the features of a first embodiment of the present invention.

The heating system 10 also includes a carrier block 40, which may be in the nature of a solid rectangular block of a suitable material, such as aluminum, having a high thermal conductivity. The carrier block 40 has parallel top and bottom faces 41 and 42 and is dimensioned to just fit in the well 20. Formed in the top face 41 are a plurality of circularly cylindrical receptacle bores 43, which terminate just short of the bottom face 42 and are sized to respectively receive associated articles to be heated, such as test tubes 44 (FIG. 1). Formed in the bottom face 42 of the block 40 centrally thereof and extending substantially perpendicular thereto is a cylindrical bore 45, which terminates substantially at the center of the block 40 and is shaped and positioned to slidably receive therein the sleeve 31 of the temperature probe assembly 30 when the carrier block 40 is placed in the well 20, as can be seen in FIGS. 4 and 6. Also formed in the top face 41 of the carrier block 40 is an internally threaded cylindrical bore 46 for threadedly receiving therein one end of an L-shaped handle 47 to facilitate handling of the block 40 during insertion into and removal from the well 20.

In use, it will be appreciated that, when it is desired to heat the contents of test tubes 44, the tubes 44 are placed in receptacles 43 in the block 40, and the block 40 is then deposited in the well 20 by means of the handle 47. Preferably, the carrier block 40 is dimensioned for close fit in the well 20, so that when it is inserted in place the sleeve 31 of the temperature probe assembly 30 is automatically received into the bore 45 in the bottom of the carrier block 40, resulting in the thermistor 35 being positioned substantially centrally of the block 40.

It will be further understood that the base plate 21 and the sleeve 31 are formed of suitable thermally conductive material, such as suitable metals. Thus, when the electric heater 25 is actuated, heat will be transferred by conduction through the base plate 21 into the block 40 and thence into the contents of the test tubes 44, all in a known manner. However, in this case, it is not necessary to manually ascertain the temperature of the test tube contents by insertion of a thermometer into a test tube 44. Rather, the temperature probe assembly 30 automatically senses the temperature at the center of the block 40 and, thereby, the temperature of the contents of the test tubes 44, this temperature being automatically registered on the LED display 38.

Figure 2:
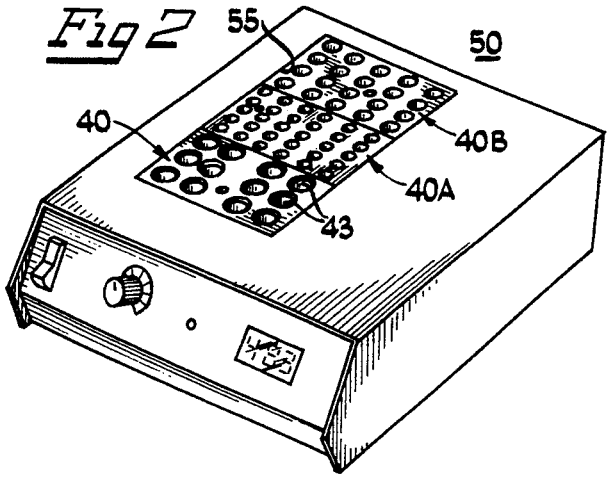
FIG. 2 is a perspective view, similar to FIG. 1, of a second embodiment of the invention.

Referring to FIG. 2, there is illustrated a modified heating system 50 which is substantially identical to the heating system 10 of FIG. 1, except that the heating system 50 includes a well 55 which is three times the size of the well 20. Thus, the well 55 can accommodate three carrier blocks 40, 40A and 40B, which may be substantially identical or may have different numbers and sizes of receptacles 43 therein. However, while there may be more than one carrier block in the well 55, there is only a single temperature probe assembly 30 at the forward end of the well 55, so that it will be received in the forwardmost carrier block 40. There is no need for multiple probe assemblies, since it is assumed that the carrier blocks will all be heated uniformly. While the heating system 50 has been illustrated as designed for accommodating three carrier blocks, it will be appreciated that the well 55 could be shaped and dimensioned to accommodate any desired number of carrier blocks.

From the foregoing, it can be seen that there has been provided an improved heating system which is of simple and economical construction and which provides an automatic sensing of the temperature of articles to be heated.

We claim:

1. A heating system comprising: a base plate, a heater for heating said base plate, a rigid self-supporting thermoelectric temperature probe assembly upstanding from said base plate and terminating in a tip for sensing the temperature at the tip and producing an electrical output signal representing the temperature sensed, an indicator coupled to said probe assembly and responsive to said output signal for producing an indication of the temperature sensed, and a block of material having a high thermal conductivity and freely removably receivable on said base plate in a heating position, said block having a top face and a bottom face and a plurality of receptacles formed in said top face for receiving associated articles to be heated, said block having a bore formed in said bottom face and dimensioned for freely receiving therein said probe assembly when said block is disposed in its said heating position for measuring the temperature within said block and thereby the temperature of articles being heated, said probe assembly being freely separable from said block when said block is removed from said base plate.

2. The heating system of claim 1, and further comprising a housing accommodating said base plate and said heater and said probe assembly and said indicator.

3. The heating system of claim 2, wherein said housing includes wall structure upstanding from said base plate about the periphery thereof for cooperation therewith to define a open-top well for receiving said block therein.

4. The heating system of claim 1, wherein said probe assembly includes a rigid tubular sheath fixed to said base plate and upstanding therefrom and defining said tip.

5. The heating system of claim 4, wherein said probe assembly further includes a thermistor disposed within said sheath at said tip.

6. The heating system of claim 4, wherein said sheath is disposed substantially perpendicular to said base plate.

7. The heating system of claim 1, wherein said block is formed of aluminum.

8. The heating system of claim 1, wherein said bore terminates substantially at the center of said block.

9. The heating system of claim 1, and further comprising a plurality of said blocks dimensioned so as to be simultaneously receivable on said base plate.

10. The carrier of claim 1, wherein said block further includes an internally threaded bore formed in said top face, and a handle threadedly engageable in said threaded bore.

11. A heating system comprising: a base plate, a heater for heating said base plate, a rigid thermoelectric temperature probe assembly upstanding from said base plate and terminating in a tip for sensing the temperature at the tip and producing an electrical output signal representing the temperature sensed, said probe assembly including a rigid tubular sheath fixed to said base plate and projecting thereabove and having an open proximal end and a closed distal end defining said tip, and an indicator coupled to said probe assembly and responsive to said output signal for producing an indication of the temperature sensed.

12. The heating system of claim 11, and further comprising a housing accommodating said base plate and said heater and said probe assembly and said indicator.

13. The heating system of claim 12, wherein said housing includes wall structure upstanding from said base plate about the periphery thereof for cooperation therewith to define a open-top well.

14. The heating system of claim 11, wherein said probe assembly includes a rigid tubular sheath fixed to said base plate and upstanding therefrom and defining said tip.

15. The heating system of claim 14, wherein said probe assembly further includes a thermistor disposed within said sheath at said tip.

16. The heating system of claim 11, wherein said indicator includes an LED display.

* * * * *